US010782090B2

(12) United States Patent
Bridgwater

(10) Patent No.: US 10,782,090 B2
(45) Date of Patent: Sep. 22, 2020

(54) PROJECTILE LAUNCHING DEVICE

(71) Applicant: Dan's Cannons Limited, Birmingham, West Midlands (GB)

(72) Inventor: Daniel Bridgwater, Birmingham (GB)

(73) Assignee: Dan's Cannons Limited, Birmingham, West Midlands (GB)

( * ) Notice: Subject to any disclaimer, the term of this patent is extended or adjusted under 35 U.S.C. 154(b) by 0 days.

(21) Appl. No.: 16/619,196

(22) PCT Filed: Jun. 18, 2018

(86) PCT No.: PCT/EP2018/066081
§ 371 (c)(1),
(2) Date: Dec. 4, 2019

(87) PCT Pub. No.: WO2018/234225
PCT Pub. Date: Dec. 27, 2018

(65) Prior Publication Data

US 2020/0116454 A1 Apr. 16, 2020

(30) Foreign Application Priority Data

Jun. 21, 2017 (GB) ..... 1709896.3

(51) Int. Cl.
*F41B 11/66* (2013.01)
*F41B 11/89* (2013.01)

(52) U.S. Cl.
CPC ..... *F41B 11/66* (2013.01); *F41B 11/89* (2013.01)

(58) Field of Classification Search
CPC ..... F41B 11/66; F41B 11/89
USPC ..... 124/63, 64
See application file for complete search history.

(56) References Cited

U.S. PATENT DOCUMENTS

| | | | | |
|---|---|---|---|---|
| 650,633 | A * | 5/1900 | Cooper | F41B 11/66 124/64 |
| 1,033,094 | A | 7/1912 | Fuda | |
| 2,993,297 | A | 7/1961 | Bednar et al. | |
| 4,086,902 | A | 5/1978 | Reynolds | |
| 4,159,705 | A * | 7/1979 | Jacoby | F41B 11/66 124/63 |
| 2004/0226548 | A1* | 11/2004 | Jordan | F41B 11/89 124/55 |
| 2006/0283432 | A1* | 12/2006 | Schwartz | A63J 5/025 124/64 |
| 2009/0159063 | A1 | 6/2009 | Hippely | |
| 2009/0272370 | A1 | 11/2009 | Bernstein | |

FOREIGN PATENT DOCUMENTS

| | | |
|---|---|---|
| DE | 452689 C | 11/1927 |
| GB | 243572 A | 12/1924 |

OTHER PUBLICATIONS

Dan'S Cannons "More Dragon Cannon Blasting" Facebook posting May 1, 2017; https://www.facebook.com/425632150811432/videos/1523030774404892; Screen capture attached.
UKIPO search report for the priority UK application.

(Continued)

*Primary Examiner* — Bret Hayes
(74) *Attorney, Agent, or Firm* — Michael J. Brown

(57) ABSTRACT

The invention relates to a projectile launching device (10). The invention also relates to a method of using a projectile launching device (10).

20 Claims, 12 Drawing Sheets

(56) References Cited

OTHER PUBLICATIONS

Machine translation of DE 452689.
www.dans-cannons.co.uk web site; Screen capture attached.
Dan's Cannons Facebook Business pages: : https://www.facebook.com/Dans-Cannons-Limited-425632150811432/; Screen capture attached.

* cited by examiner

PROJECTILE LAUNCHING DEVICE

The invention relates to a projectile launching device.

An aim of the present invention is to provide an improved projectile launching device, and/or at least an alternative projectile launching device, and/or projectile launching device that has new applications.

According to the invention there is provided a projectile launching device in accordance with claim 1.

For the avoidance of doubt, the object of spherical cross section referred to in claim 1 is not a feature of claim 1. Instead, it is a feature which the features of claim cooperate with.

Other optional and preferred features of the projectile launching device in accordance with the invention are set out in the dependent claims, and the description, and the drawings. It will be appreciated that the features of the independent claims can be combined in any complimentary manner, with one or more features of another independent claim, the dependent claims, and/or with one or more features of the description, and/or with one or more features of the drawings, where such a combination of features would result in a working embodiment of the invention.

Figure 1:
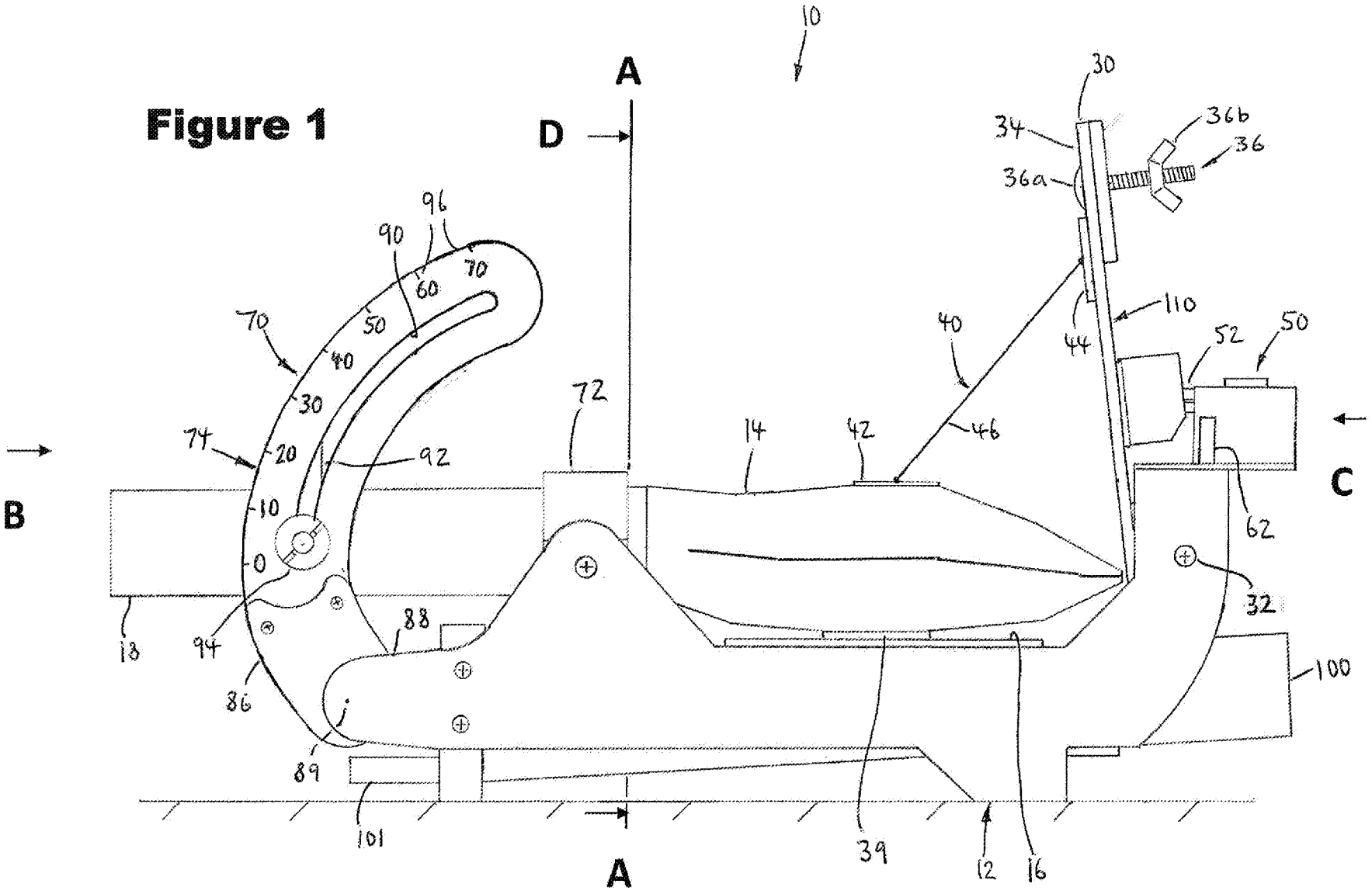
Figure 2:
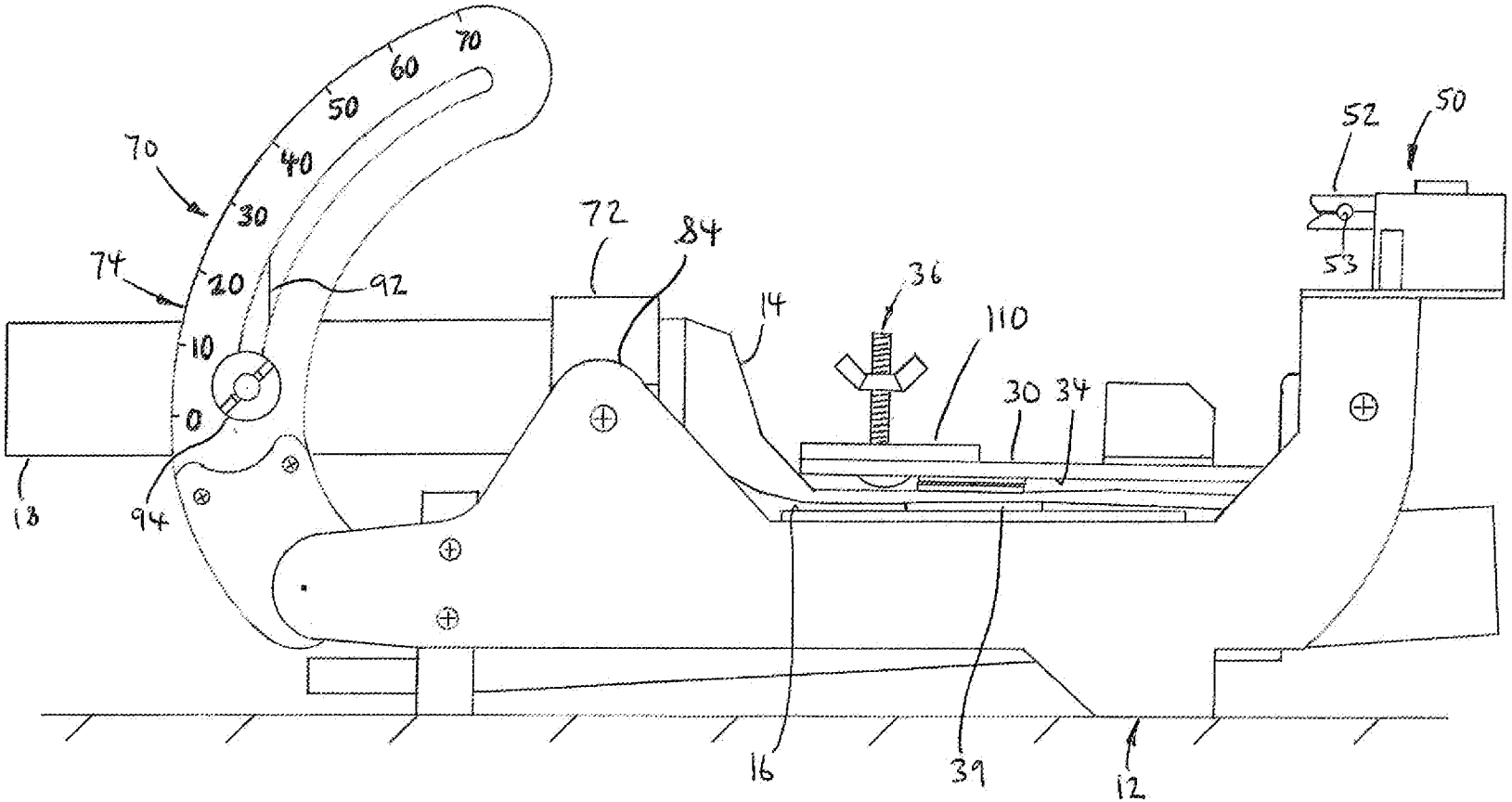
Figure 3:
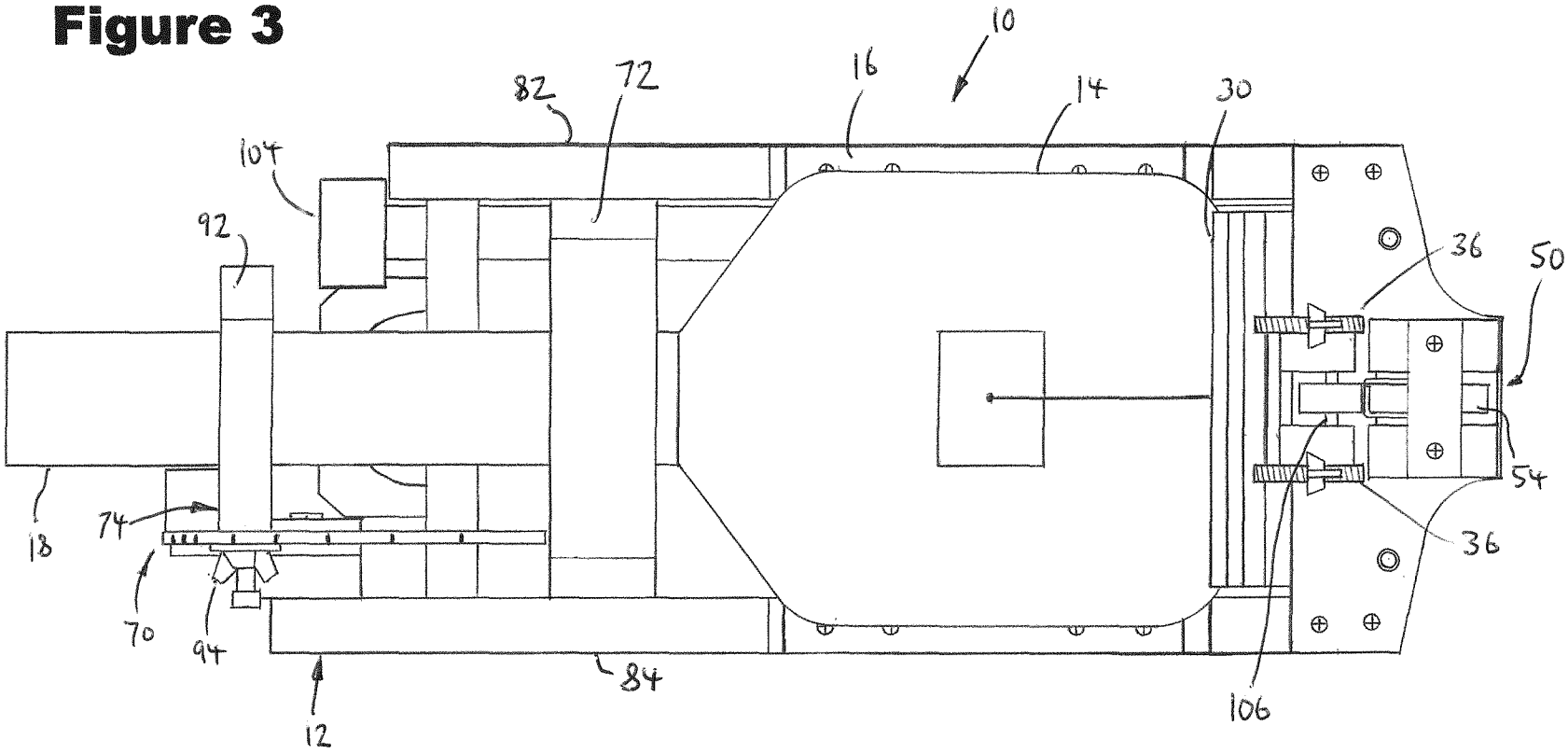
Figure 4:
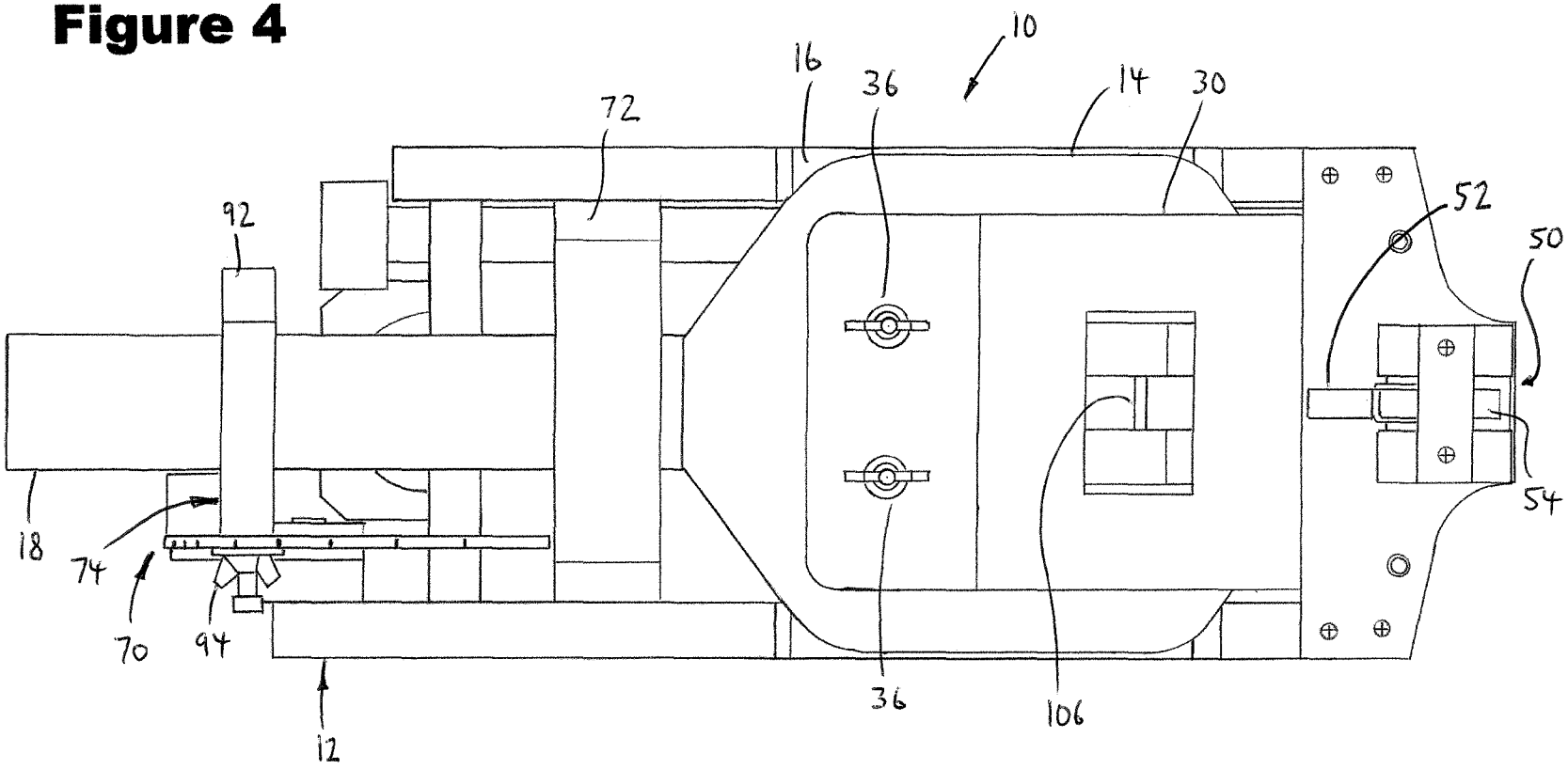
Figure 5:
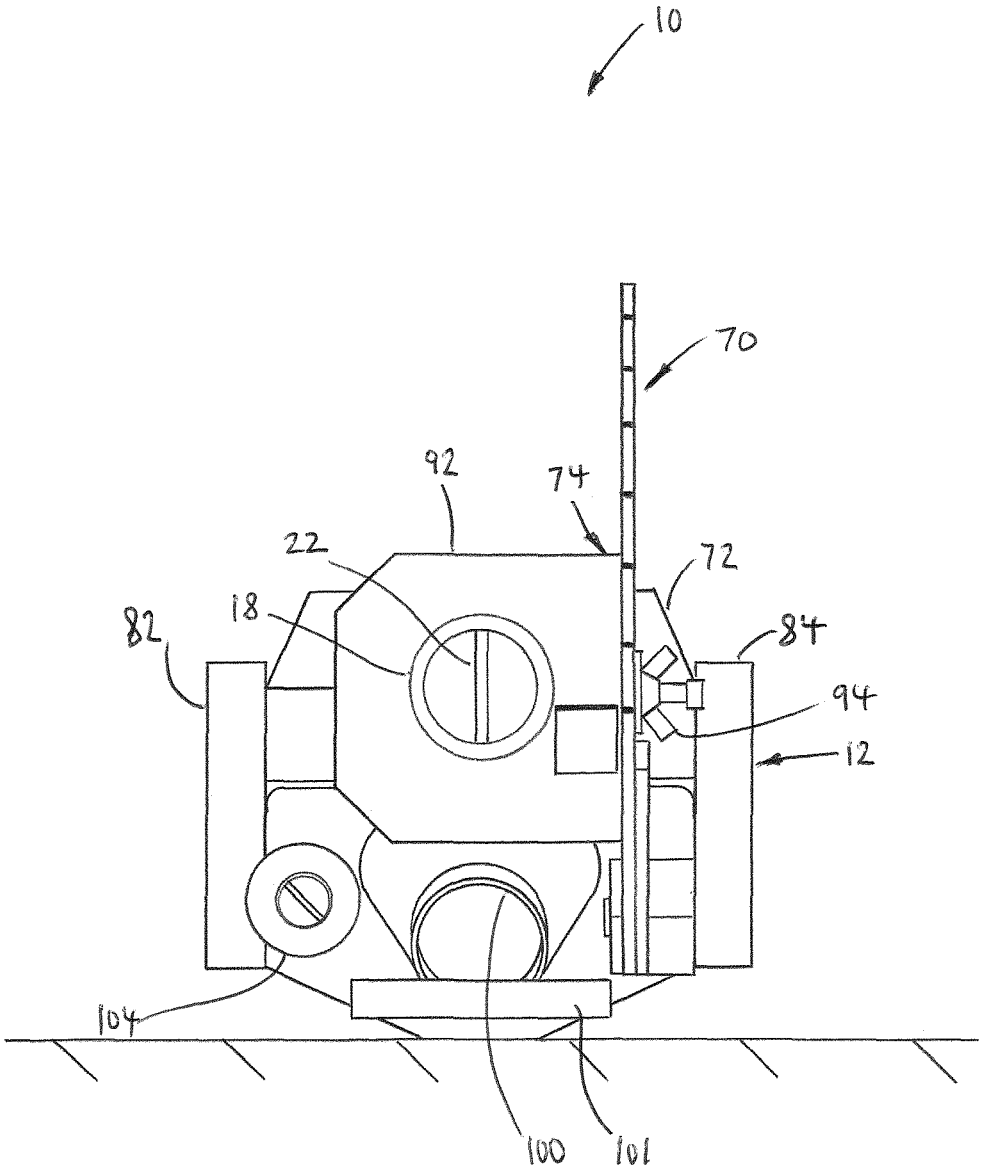
Figure 6:
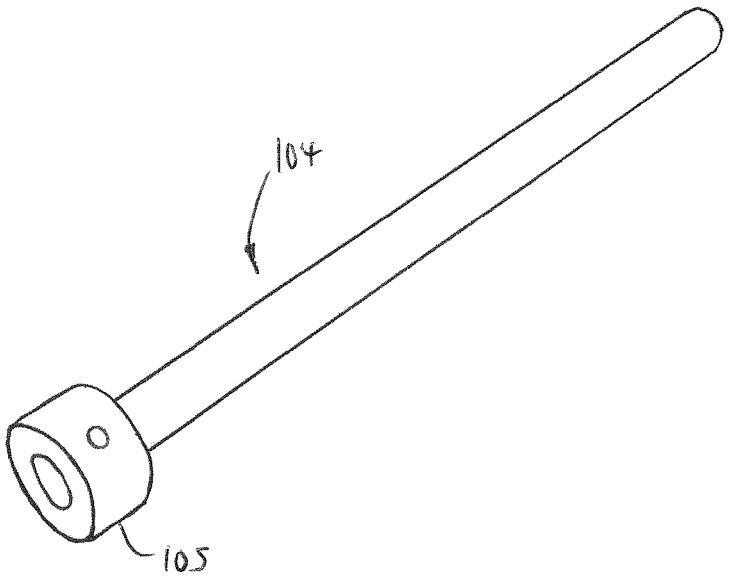
Figure 7A:
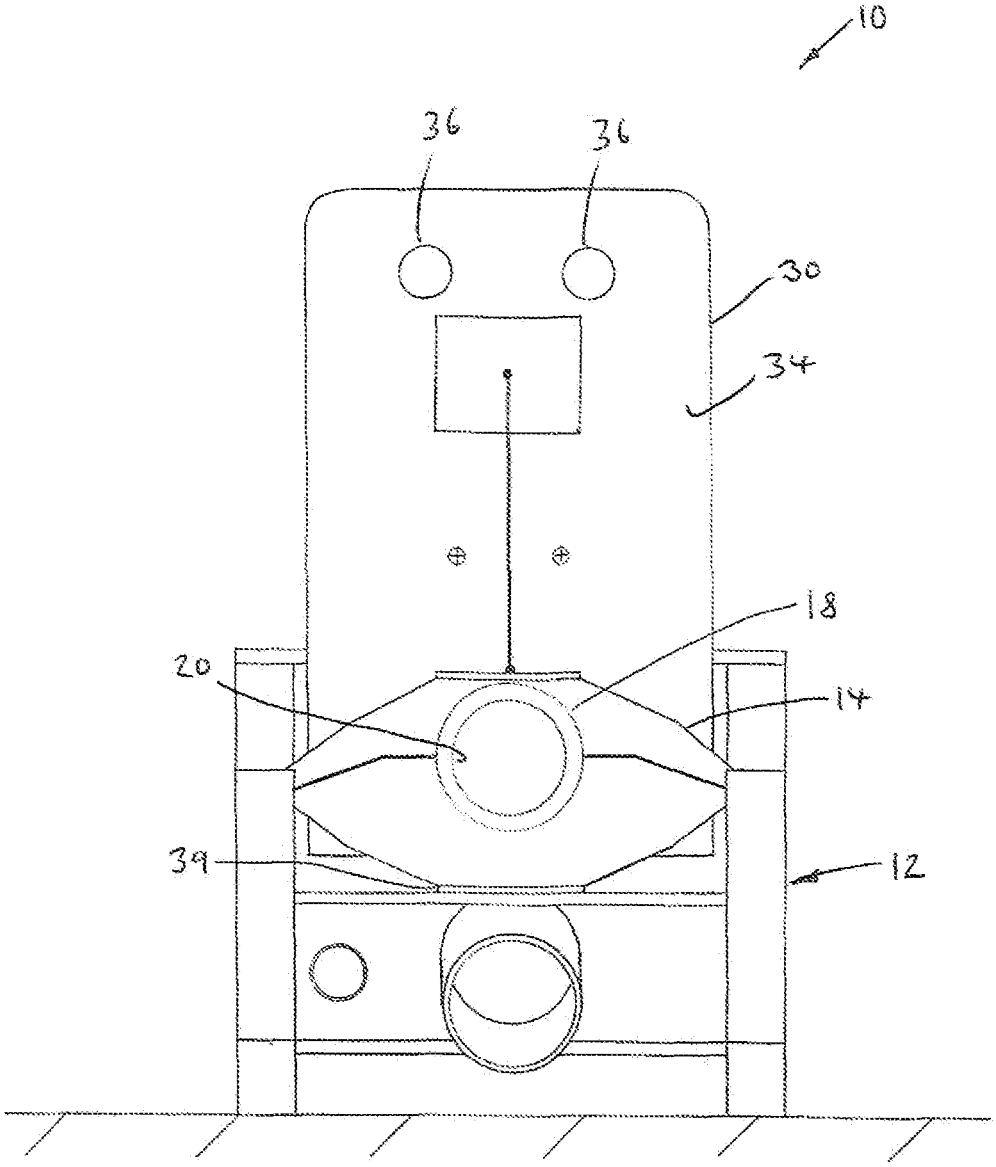
Figure 7B:
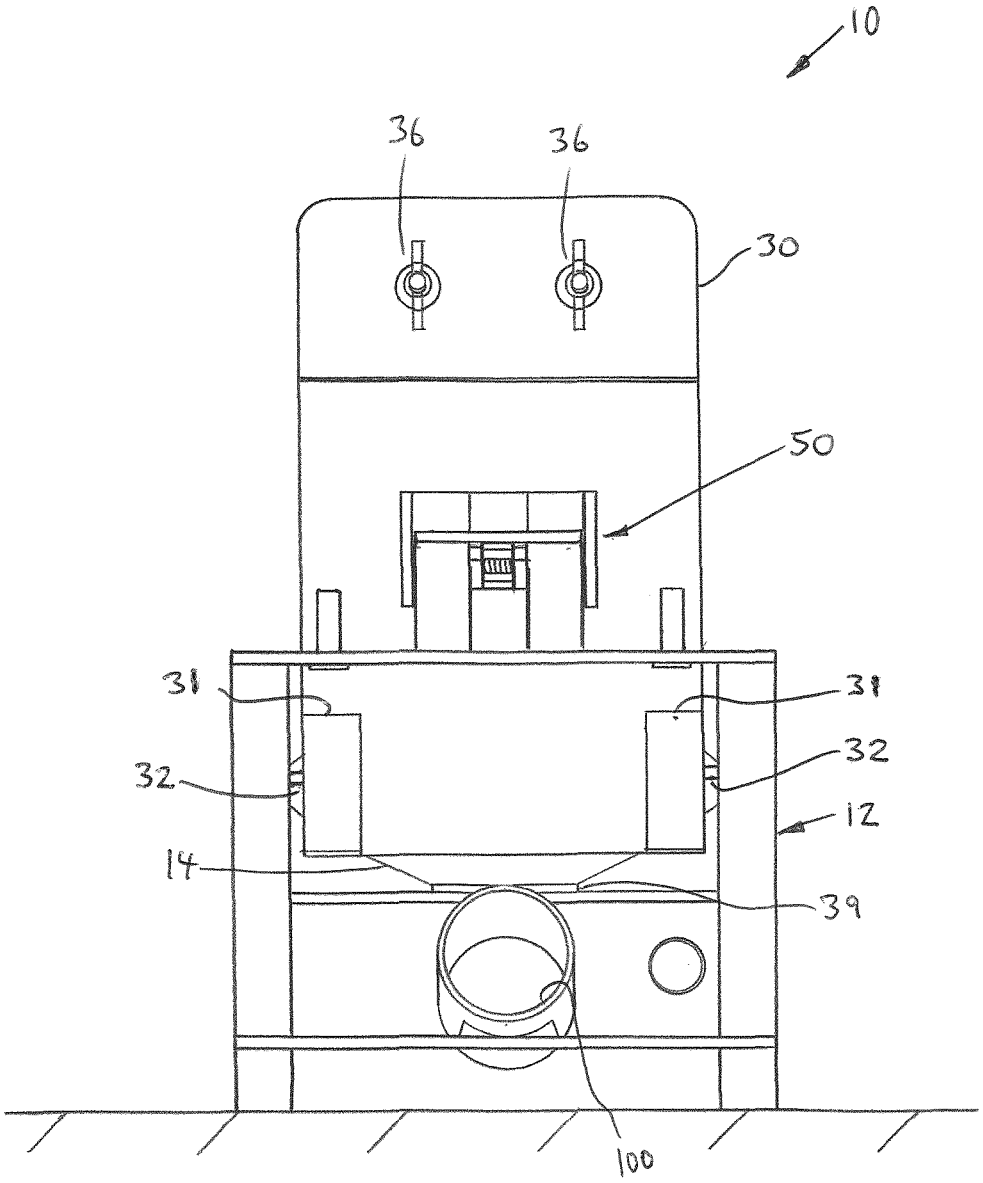
Figure 8:
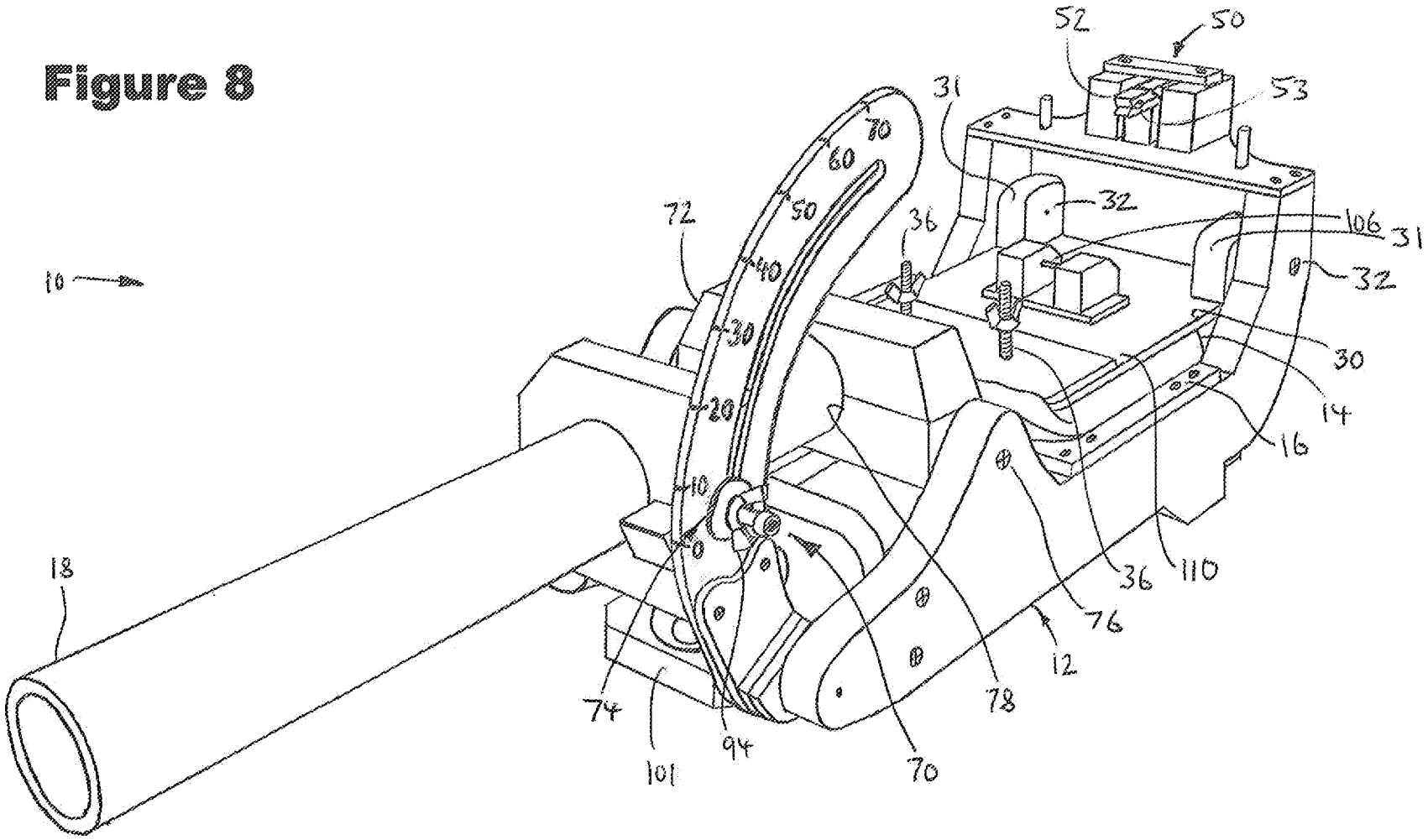
Figure 9:
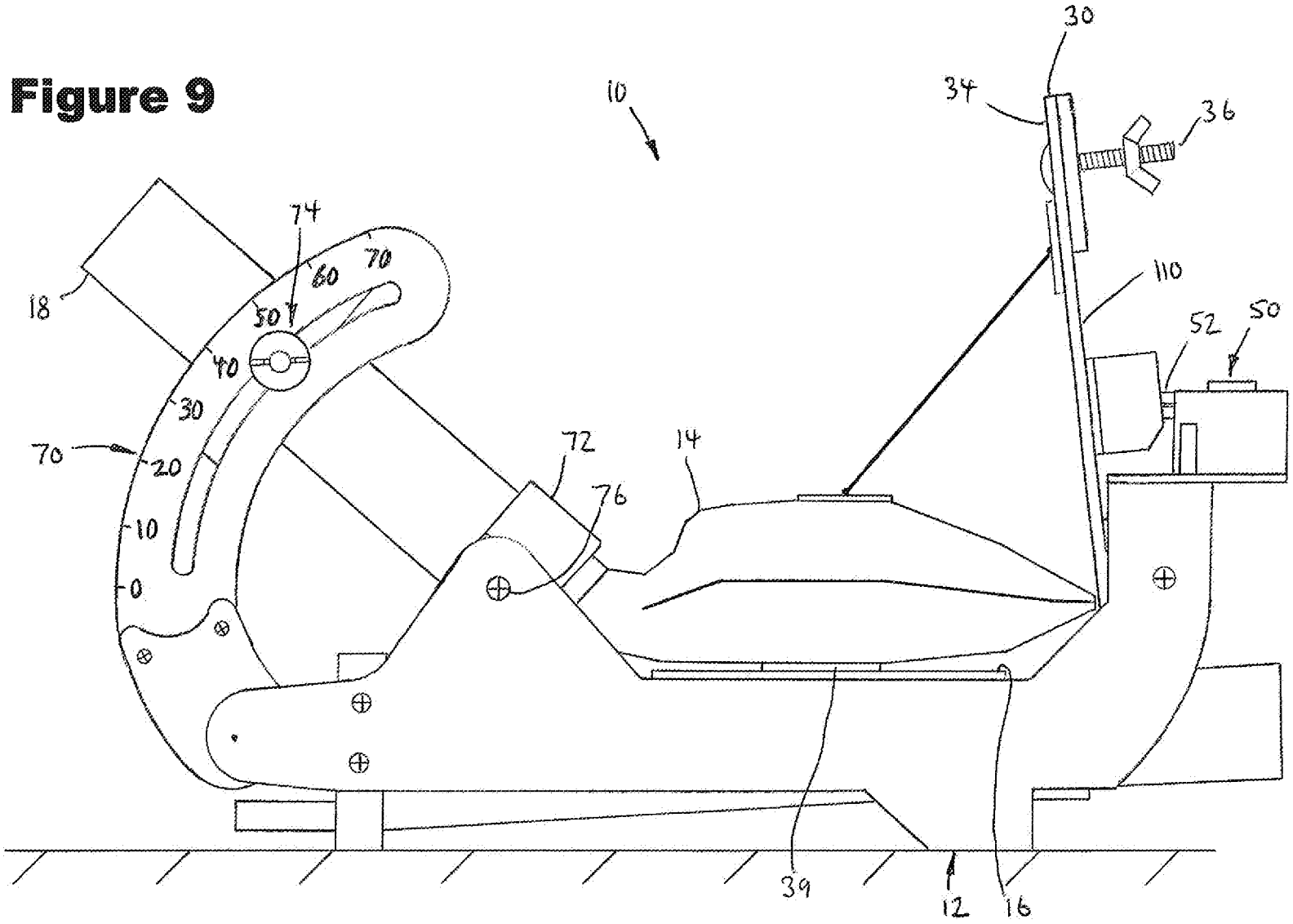
Figure 10:
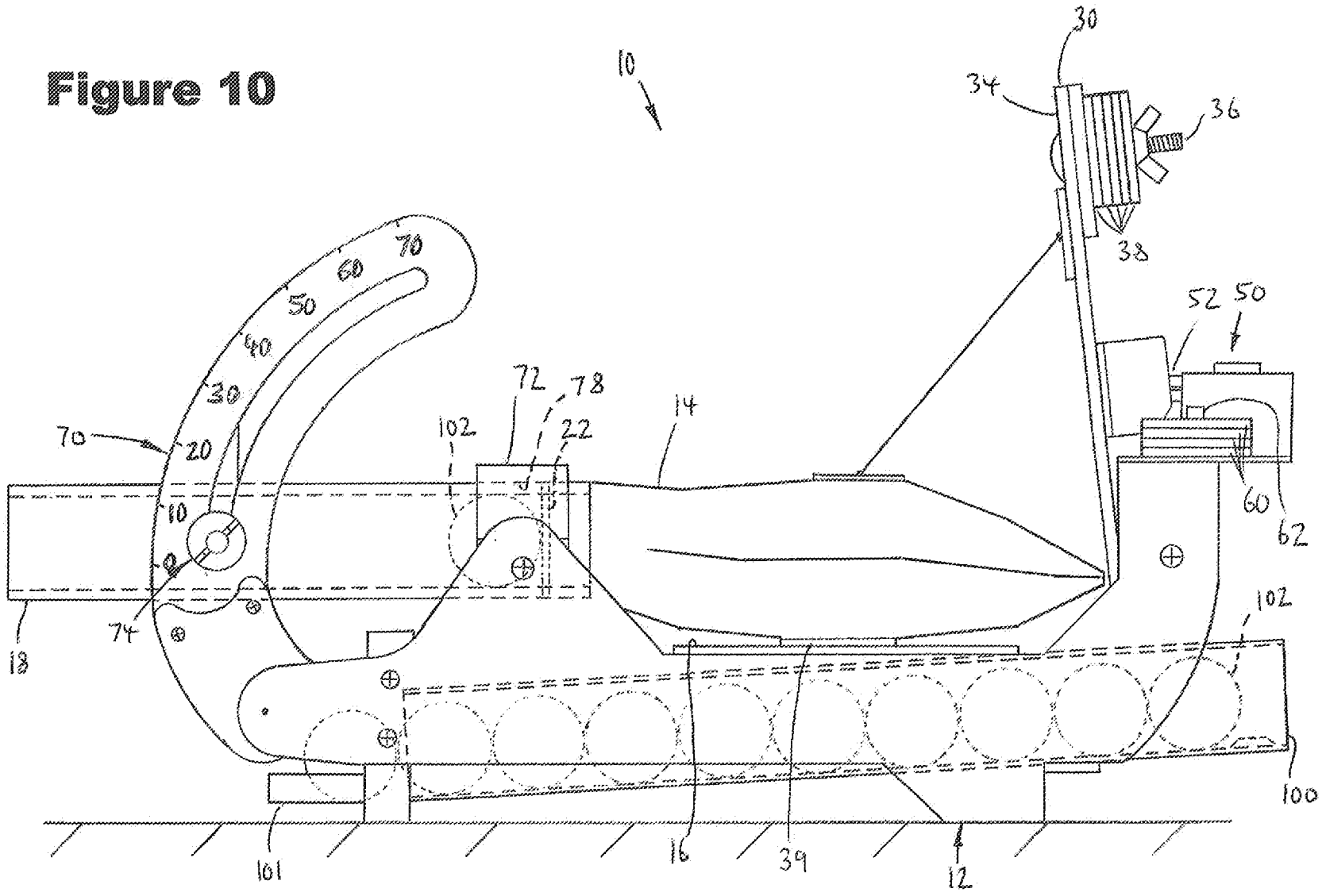
Figure 11:
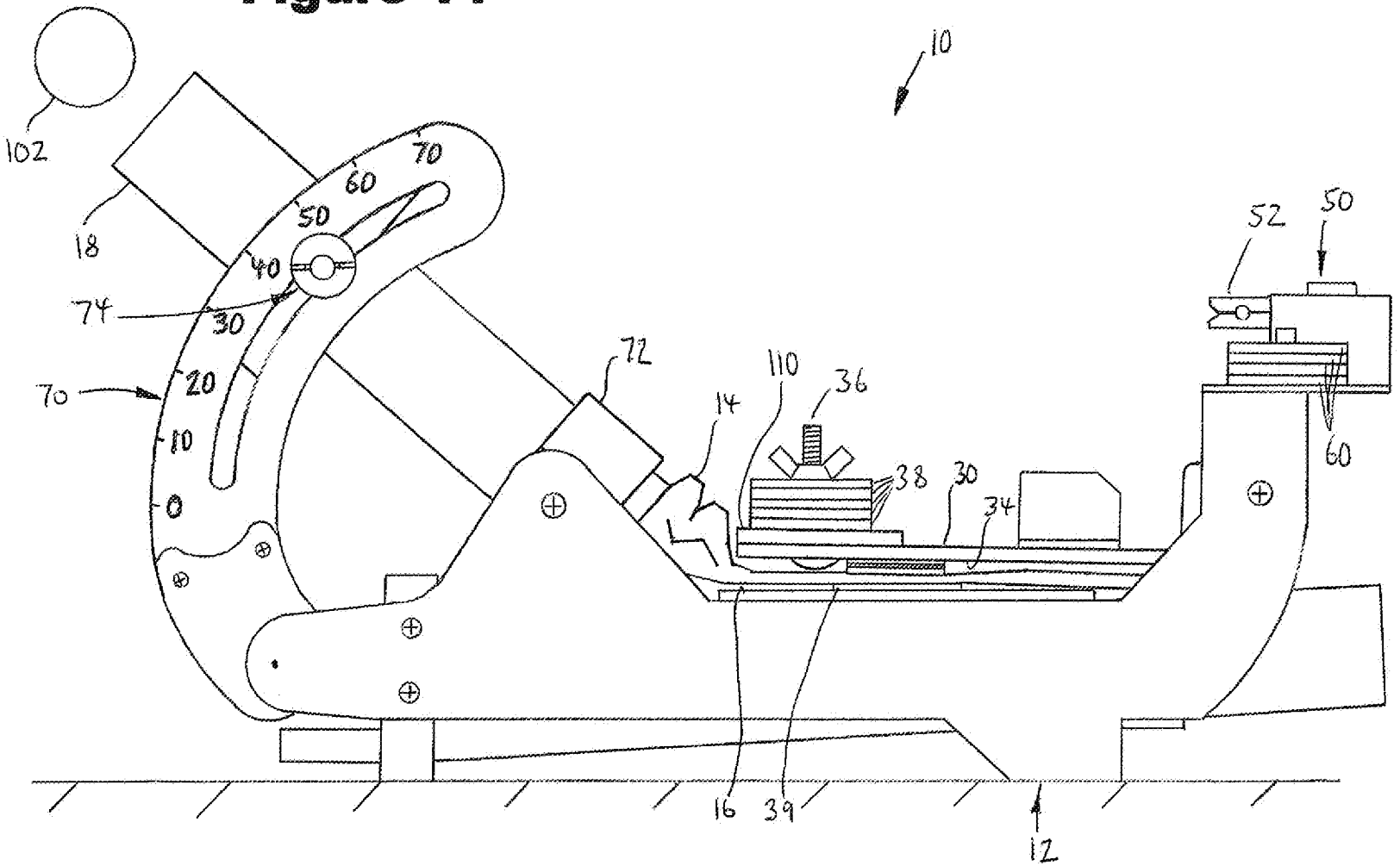

A projectile launching device and a projectile launching device kit in accordance with the invention will now be described, by way of example only, with reference to the accompanying drawings, in which, FIG. 1 is a side view of a projectile launching device, in a first operational configuration, charged (meaning ready to fire), FIG. 2 is another side view of the projectile launching device of FIG. 1, in a second operational configuration, discharged (meaning fired), FIG. 3 is a plan view of the projectile launching device of FIG. 1, in the charged operational configuration, FIG. 4 is a plan view of the projectile launching device of FIG. 1, in the discharged operational configuration, FIG. 5 is an end view of the part of the projectile launching device, taken in the direction of arrow B in FIG. 1, the end view omitting detail to the right hand side of line A-A in FIG. 1 to maintain simplicity and clarity in the drawing, FIG. 6 is a perspective view of a loading member of the projectile launching device kit, the loading member to be used with the projectile launching device, FIG. 7A is a view of the part of the projectile launching device taken from line A-A in FIG. 1 in the direction of arrow D, FIG. 7B is an end view of the part of the projectile launching device, taken in the direction of arrow C in FIG. 1, the end view omitting detail to the left hand side of line A-A in FIG. 1 to maintain simplicity and clarity in the drawing, FIG. 8 is a perspective view from the front and to the side of the projectile launching device, FIG. 9 is a side view of the projectile launching device, in a charged operational configuration, showing the tube in a second angle of inclination, FIG. 10 is a side view of the projectile launching device, in a charged operational configuration, with balls installed in tube and in the storage tube, and weights on the drop mass, and weight storage spindles, and FIG. 11 is a side view of the projectile launching device, in a discharged operational configuration, with balls ejected from tube, and weights on the drop mass, and weight storage spindles.

Referring to FIGS. 1 and 2, a projectile launching device 10 comprises a support structure 12, a flexible air bag 14 arranged on an impact support surface 16 of the support structure, and a tube 18, the interior of which is in air flowing communication with the interior of flexible air bag 14 (In the embodiment shown, the flexible air bag 14 comprises an opening 20 (schematically indicated by reference numeral 20 in FIG. 7A), at which point the flexible air bag 14 is connected to an end of the tube 18, and the interior of the tube 18 and the interior of the flexible air bag 14 are directly connected. Other embodiments are envisaged where the flexible air bag 14 is not directly connected to an end of the tube 18, i.e. where the flexible air bag 14 is connected to an end of the tube 18 via one or more intermediate parts, and such embodiments are within the scope of the invention).

The tube 18 is made of rigid, clear, material, and the inside surface of the tube 18 is of spherical cross section, it being designed to receive a ball 102 (or other projectile of spherical cross section). In other embodiments of the invention, the inside surface of the tube 18 could be non spherical cross section. The inside surface of the tube 18 is smooth so as to minimise frictional effects if a ball 102 and air pass through the tube. The tube 18 is shown truncated compared to its actual length in the Figures, with the exception of FIG. 8 which shows the length of the tube in its entirety.

The impact support surface 16 is made of a rigid material and is flat or substantially flat.

The term "air bag" means a bag or a receptacle for air. Whilst flexible, like the material of bellows, the flexible air bag 14 is not elastic in nature.

Referring to FIGS. 5 and 10, the projectile launching device 10 comprises a ball stopping member 22, which stops a ball passing from the tube 18 into the air bag. The ball stopping member 22 can take any form but its form should be designed to minimise disruption inside the tube and therefore minimise frictional effects if air passes through the tube.

Referring to FIGS. 1 to 4, 7A, 7B, and 8 to 11, the projectile launching device 10 comprises a movable mass 30. In the embodiment shown, mountings 31 attached to the movable mass 30 are pivotably fixed to the support structure 12 via conventional screw fasteners at a pivot axis 32. Referring to FIGS. 1, 2, 7A, 9, 10 and 11, the movable mass 30 comprises an impacting surface 34. The impacting surface 34 is made of a rigid material and is flat or substantially flat. The impacting surface 34 is arranged to pivot about the pivot axis 32 into abutment with the impact support surface 16 of the support structure 12. Other embodiments are envisaged where an impacting surface of a movable mass moves into abutment with an impact support surface of a support structure in a different manner.

Referring to FIGS. 1 to 4, 7A, 7B, and 8 to 11, the movable mass 30 comprises an additional mass storage means 36, arranged on an upper surface 110 (upper in FIG. 1) of the movable mass 30, in other words on the surface which faces away from the impacting surface 34. Referring to FIG. 1, the additional mass storage means 36 comprises headed threaded fasteners **36*a* arranged through the movable mass 30 and secured by a nut 36*b*. The figures show the heads of the fasteners 36*a* protruding from the impacting surface 34, but in practice the heads of the fasteners 36*a* would be recessed, or protrude only to an extent whereby they do not significantly influence the contact between the impact support surface 16 and the impacting surface 34. Referring to FIGS. 10 and 11, additional mass(es) 38 can be added onto the additional mass storage means 36, and secured there, so as to increase the effective mass of the movable mass 30**, and therefore the resulting impact force of the movable mass.

Referring to FIGS. 3, 4, 7B, and 8, the projectile launching device 10 comprises a first latch element 106, arranged on the upper surface 110 of the movable mass 30.

Referring to FIGS. 1, 2, 7A, 7B, and 9 to 11, the impact support surface 16 is coupled to (an underside of) the flexible air bag 14 by a first coupling 39, which can conveniently take the form of a Velcro™ fastener. (An upper side of) the flexible air bag 14 is coupled to the impacting surface 34 by a second coupling 40. The second coupling 40 comprises a Velcro™ fastener 42 on upper side of air bag 14, a Velcro™ fastener 44 on underside of movable mass 30, and an inextensible length of material such as string or the like 46 connecting the two fasteners 42, 44. The positions of the impact support surface 16, the impacting surface 34, the geometry of the flexible air bag, the first coupling 39 and the second coupling 40, are designed so that a first (upper side of) the flexible air bag 14 is spaced by a predetermined distance from a second (underside of) the flexible air bag 14. The first coupling 39, second coupling 40, and the length of string or the like 46 are dimensioned so as to not significantly influence the contact between the impact support surface 16 and the impacting surface 34.

Referring to FIGS. 1, 3, 4, 7B, and 8 to 11, the projectile launching device 10 comprises a movable mass activation means 50. The movable mass activation means 50 is mounted on the support structure 12.

Referring to FIGS. 1, 2, 8, and 9 to 11, the movable mass activation means 50 comprises a second latch element 52. Referring to FIGS. 3 and 4, the movable mass activation means 50 also comprises a trigger mechanism 54.

The second latch element 52 is arranged to face the first latch element 106, when the impacting surface 34 is moved away from the impact support surface 16 so that the first latch element 106 and second latch element 52 can come into contact with each other and engage.

The second latch element 52 comprises a pair of arms. The trigger mechanism 54 comprises a pair of arms. Somewhat obscured in the drawings, the arms of the trigger mechanism 54 are broadly speaking in line with the arms of the second latch element 52. The arms of the second latch element 52 and the arms of the trigger mechanism 54 are connected at a sprung pivot in the manner of a known clothes peg. When not triggered, the sprung pivot biases the two arms of the second latch element 52 to be aligned and define an opening 53 (see FIGS. 2 and 8) between them, and movement of the two arms of the trigger mechanism 54 together, causes the two arms of the second latch element 52 to move apart, which in turn will release the first latch element 106.

In the embodiment shown, the first latch element 106 is a pin or the like, and the second latch element 52 is a manually resiliently deformable retention means. However, the reader will appreciate that the positions of the first latch element 106 and the second latch element 52 could be reversed.

Although "engagement" of the first latch element 106 and the second latch element 52 is described hereinabove, other forms of connection between the movable mass 30 and the support structure 12 are possible.

Referring to FIGS. 10 and 11, the projectile launching device 10 also comprises additional mass(es) 60, which can be arranged on additional mass(es) holders 62 of the support structure 12.

Referring to FIGS. 1 to 5, 8, and 9 to 11, the projectile launching device 10 comprises a tube inclination angle adjustment and fixing means 70, which enables the inclination angle, i.e. the angle of inclination relative to the horizontal, to be adjusted, and the inclination angle to be fixed. Referring to FIGS. 1 to 5, and 8 to 11, the tube inclination angle adjustment and fixing means 70 comprises a first tube inclination angle adjustment part 72. Referring to FIGS. 1 to 4, and 8 to 11, the tube inclination angle adjustment and fixing means 70 also comprises a second tube inclination angle adjustment part 74.

Referring to FIGS. 8 and 9, the first tube inclination angle adjustment part 72 is rotationally arranged on a spindle 76 that extends between spaced apart members 82, 84 (see FIG. 5) of the support structure 12, at a first place on the support structure. Referring to FIGS. 8 and 10, the first tube inclination angle adjustment part 72 defines an aperture 78 in which the tube 18 is mounted.

Referring to FIG. 1, the second tube inclination angle adjustment part 74 comprises an elongate member 86 rotationally fitted to an arm 88 of the support structure 12 by a spindle 89, at a second place on the support structure. The elongate member 86 comprises a (closed) channel 90. Referring to FIGS. 1 to 5, and 8, the second tube inclination angle adjustment part 74 also comprises a tube mounting 92. A headed pin 94 passes through the channel 90 into the tube mounting 92, and the headed pin can be adjusted to clamp the elongate member 86 to the tube mounting 92 at a position corresponding to a predetermined inclination angle. Referring to FIG. 1, the elongate member 86 comprises indicia 96, running broadly speaking along the length of the channel 90, to allow the inclination angle of the tube 18, in the embodiment shown in terms of degrees relative to the horizontal, to be measured.

Referring to FIGS. 1, 5, 7B, and 10, the projectile launching device 10 comprises a ball storage 100, which stores balls 102. The ball storage 100 comprises a tube, which is inclined, downwardly from right to left in FIG. 1, so that balls are biased to roll towards the left hand end of the ball storage, which is nearer the open end of the tube 18. Referring to FIGS. 1, 8, and 10, at the left hand end of the ball storage 100, the ball storage comprises a bumper type stopper 101 which defines a recess which a ball 102 (to be used next) can sit in and easily accessed by an operator.

Referring to FIG. 6, the projectile launching device 10 comprises a loading member 104. A handle 105 of the loading member 104 is enlarged relative to a elongated rod part of the loading member. The length of the elongated rod part is sized such that when the handle 105 abuts the end of the tube 18, with the rod part inside the tube, a ball 102 in the tube arranged between the end of the rod and the ball stopping member 22 has some space to move in the direction of the axis of the tube, hence avoiding damage to the ball or stopping member. The handle 105 is circular in cross section, and of a diameter greater than the inner diameter of the tube 18, so that the loading member cannot fall fully into the tube 18.

It will be appreciated by the reader that in the embodiment shown in the drawings the projectile launching device 10 resembles a cannon.

A projectile launching device kit comprises the projectile launching device 10, the balls 102, and the additional mass(es) 60.

A method of using the projectile launching device 10 follows.

Referring to FIGS. 1 and 10, optionally, additional mass(es) 60 is/are arranged on the additional mass(es) holders 62.

Then, in accordance with the invention, the movable mass 30 is pivotably moved away from the impact support surface 16, the movable mass 30 pulling, via the length of string or the like 46, the upper side of the flexible air bag 14 away from the underside of the flexible air bag. The opening of the flexible air bag 14 draws atmospheric air into the flexible air bag. In other words, moving the movable mass 30 away from the impact support surface 16 has the effect of inflating the flexible air bag 14.

Then, as shown clearest in FIG. 4, the first latch element 106 of the movable mass 30 can be releasably secured to the second latch element 52. Looking at FIGS. 1 and 9 for example, it will be appreciated by the reader that the latching/stopping position of the movable mass 30 is such that the plane of the movable mass is slightly off the vertical, slightly nearer to the impact support surface 16. In other words, the angle between the plane of the impacting surface 34 and the impact support surface 16 is less than 90 degrees. In this way, the movable mass 30 is not in equilibrium, but it is biased to fall towards the impact support surface 16 as soon as the second latch element 52 is released.

Referring to FIG. 10, a ball 102, most preferably in the form of a table tennis ball, is taken out of the ball storage 100. In accordance with the invention, table tennis balls have been carefully selected for use because they are light, have a smooth low friction outer surface, have a rigid outer surface, and their size is highly standardized from one manufacturer to another, in contrast with for example tennis balls.

Referring to FIG. 10, when a ball 102 is required, it is taken from the bumper type stopper 101 of the ball storage 100.

The loading member 104, stowed as shown in FIGS. 3 to 5 when not being used, is used to insert a ball 102 into the tube 18, until the ball is adjacent or abuts the ball stopping member 22, without the ball applying pressure on the stopping member. Thus, the ball 102 closes or substantially closes the tube 18 so as to restrict air flowing between the tube 18 and the flexible air bag 14.

It is beneficial if the sequence of events is 1. Move the movable mass 30 to open and inflate air bag, then 2. Insert ball 102, rather than 1. Insert ball, then 2. Move the movable mass 30 to open and inflate air bag. Due to the diameter of the ball being only slightly less than the inner diameter of the tube 18, there is some air resistance to the movement of the ball if the air bag is opened and inflated after the ball has been placed in the tube. The preferred sequence allows air to be sucked through a less restricted opening than if the ball were pre-installed, which in turn minimises the work done by the flexible air bag 14, and connections 40, 42, 44, 46. Also, due to the close fit between the ball 102 and the tube 18, pushing the ball into the tube after the air bag has been inflated can in fact top up the flexible air bag 14 with additional air.

The inclination angle of the tube 18 can be optionally adjusted using the tube inclination angle adjustment and fixing means 70.

Then, the trigger mechanism 54 is depressed, to move apart the two arms of the second latch element 52. That causes the second latch element 52 to release the first latch element 106. Due to the not in equilibrium position of the movable mass 30, the movable mass 30 can then fall, pivotably in the embodiment shown, towards the flexible air bag 14, until the impacting surface 34 impacts the impact support surface 16.

The impact forces air from the flexible air bag 14 out of the opening 20 into the tube 18, thus exerting a pressure on the ball 102, consequently firing the ball 102 out of the tube as a projectile.

The projectile launching device 10 can be reloaded with a ball 102 and reused. Multiple balls 102 can be loaded in the tube 18 simultaneously, and fired from the tube simultaneously, but performance is diminished if multiple balls are fired simultaneously.

In accordance with the invention, reloading of the projectile launching device 10 is very simple.

The projectile launching device 10 is designed to project a ball 102 without additional masses 38 arranged on the movable mass 30, but additional masses can be arranged on the movable mass in order for the projectile launching device to project a ball 102 further if desired.

In the embodiment described and shown, the trigger mechanism 54 is triggered by manual depression. The trigger mechanism 54 is entirely mechanical. However, in another embodiment of the invention (not shown for conciseness) it is envisaged that a trigger mechanism could be made of electrical or electromechanical or other suitable means. For example, a magnet can be mounted on the movable mass 30 and an electromagnet can be mounted on the support structure 12, the electromagnet being used as a switch to hold or release the magnet as desired.

Indeed, the projectile launching device 10 as a whole is entirely mechanical. Other parts of the projectile launching device 10 could also be other than purely mechanical.

The projectile launching device 10 can comprise means for making sound effects such as shooting sound effects, which, and be caused by the trigger mechanism, and coincide with the moment of launching a projectile.

In one embodiment, the projectile launching device 10 has a total mass without additional masses of about 2.2 kg. In the assembled state, the greatest dimension of the projectile launching device 10 is less than one metre. Hence, an advantage of the projectile launching device 10 is that it is highly portable. Also, the design of the projectile launching device 10, and its use of only very low weight table tennis balls, and their operational velocity, mean that, across the range of usage, if a ball 102 hits a person during use of the projectile launching device, the impact from the ball 102 is generally unlikely to be harmful. In the main embodiment described herein, the projectile launching device 10 is suitable for use as a toy, or for educational purposes such as conducting scientific experiments.

In one embodiment, the projectile launching device 10 is made primarily of wood. The projectile launching device 10 can however be made of any suitable material. The projectile launching device 10 can be disassembled. Assembling the projectile launching device 10 can provide a user with a game like challenge in the same way that Lego™ or Meccano™ does. Also, the disassembled projectile launching device 10 can be optimised for minimal storage volume, and minimal packaging.

Parts of the projectile launching device 10 referenced in certain drawings may also be shown referenced in other drawings, and should be interpreted accordingly. Parts of the projectile launching device 10 referenced in certain drawings may also be shown unreferenced in other drawings, and should be interpreted accordingly.

The invention claimed is:

1. A projectile launching device comprising a flexible air bag and a movable mass, part of the flexible air bag is fixed to a part of the projectile launching device, part of the flexible air bag is coupled to the movable mass by a coupling, wherein the movable mass is designed to fall under gravity towards the flexible air bag, the movable mass can be lifted away from the flexible air bag to exert a force via the coupling onto part of the flexible air bag, to open the flexible air bag and inflate the flexible air bag with atmospheric air, and the movable mass can be dropped towards the flexible air bag to force air out of an opening in the flexible air bag, so as to project an object from the projectile launching device.

2. A projectile launching device according to claim 1, wherein the projectile launching device comprises an opening for receiving a projectile.

3. A projectile launching device according to claim 1, wherein the movable mass is designed to be lifted manually to a position from which it can fall.

4. A projectile launching device according to claim 1, wherein the movable mass is pivotably fixed to part of the projectile launching device, and falls in a motion about the pivotable fixing.

5. A projectile launching device according to claim 1, wherein the coupling comprises an inextensible length of material.

6. A projectile launching device according to claim 1, wherein the flexible air bag is designed to be sandwiched between an impacting surface of the movable mass and an impact support surface of the projectile launching device.

7. A projectile launching device according to claim 6, wherein the impacting surface and the impact support surface are designed to overlap the majority of the flexible air bag when the flexible air bag is in a compressed state.

8. A projectile launching device according to claim 1, wherein, in the position from which it can fall, the movable mass is releasably secured to part of the projectile launching device by a trigger mechanism.

9. A projectile launching device according to claim 1, wherein the projectile launching device comprises a tube for an object to be projected, the flexible air bag comprising an opening in air flowing communication with the interior of the tube.

10. A projectile launching device according to claim 9, wherein the projectile launching device comprises a projectile of circular cross section.

11. A projectile launching device according to claim 9, wherein the projectile launching device comprises a spherical projectile.

12. A projectile launching device according to claim 11, wherein the spherical projectile is a table tennis ball.

13. A projectile launching device according to claim 1, wherein the projectile launching device comprises a projectile.

14. A projectile launching device according to claim 1, wherein the projectile launching device comprises an opening for receiving a projectile of circular cross section, to restrict air flowing from the flexible air bag.

15. A projectile launching device according to claim 1, wherein the projectile launching device comprises an opening for receiving a spherical projectile, to restrict air flowing from the flexible air bag.

16. A projectile launching device according to claim 15, wherein the projectile launching device comprises an opening for receiving a table tennis ball, to restrict air flowing from the flexible air bag.

17. A projectile launching device according to claim 1, wherein the flexible air bag is designed to be sandwiched between a flat impacting surface of the movable mass and a flat impact support surface of the projectile launching device.

18. A projectile launching device according to claim 1, wherein, in the position from which it can fall, the movable mass is releasably secured to part of the projectile launching device by a mechanical trigger mechanism.

19. A projectile launching device according to claim 18, wherein the mechanical trigger mechanism is a finger operated trigger mechanism.

20. A projectile launching device comprising:

a flexible air bag and a movable mass, a tube for an object to be projected, the tube having a first diameter;

a projectile of circular cross section, the projectile having a second diameter, where the second diameter is less than the first diameter of the tube, so the projectile closely fits in the tube;

the flexible air bag comprising an opening in air flowing communication with the interior of the tube;

where part of the flexible air bag is fixed to a part of the projectile launching device, part of the flexible air bag is coupled to the movable mass by a coupling, wherein the movable mass is designed to fall under gravity towards the flexible air bag, the movable mass can be lifted away from the flexible air bag to exert a force via the coupling onto part of the flexible air bag, to open the flexible air bag and inflate the flexible air bag with atmospheric air, and the movable mass can be dropped towards the flexible air bag to force air out of an opening in the flexible air bag, so as to project the projectile from the projectile launching device.

* * * * *